US009108406B2

(12) United States Patent
Hasegawa et al.

(10) Patent No.: US 9,108,406 B2
(45) Date of Patent: Aug. 18, 2015

(54) DEVICE SUBSTRATE, LIQUID EJECTION HEAD, AND METHOD FOR MANUFACTURING DEVICE SUBSTRATE AND LIQUID EJECTION HEAD

(71) Applicant: CANON KABUSHIKI KAISHA, Tokyo (JP)

(72) Inventors: Kouji Hasegawa, Kawasaki (JP); Satoshi Ibe, Yokohama (JP); Jun Yamamuro, Yokohama (JP); Shuhei Oya, Kawasaki (JP); Shiro Sujaku, Kawasaki (JP); Junya Hayasaka, Funabashi (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/276,776

(22) Filed: May 13, 2014

(65) Prior Publication Data

US 2014/0340451 A1 Nov. 20, 2014

(30) Foreign Application Priority Data

May 15, 2013 (JP) ..... 2013-103035

(51) Int. Cl.

| | |
|---|---|
| ***B41J 2/04*** | (2006.01) |
| ***B41J 2/16*** | (2006.01) |
| ***B41J 2/14*** | (2006.01) |

(52) U.S. Cl.

CPC ..... *B41J 2/1637* (2013.01); *B41J 2/14024* (2013.01); *B41J 2/14072* (2013.01); *B41J 2/1603* (2013.01); *B41J 2/1623* (2013.01); *B41J 2/1628* (2013.01); *B41J 2/1631* (2013.01); *B41J 2/1645* (2013.01)

(58) Field of Classification Search

CPC ..... B41J 2/14427; B41J 2/1648; B41J 2/14; B41J 2202/19; B41J 2/045

USPC ..... 347/20, 54, 56, 63, 68; 29/25.35, 890.1

See application file for complete search history.

(56) References Cited

U.S. PATENT DOCUMENTS 8,286,351 B2 * 10/2012 Edamatsu et al. ..... 29/890.1

FOREIGN PATENT DOCUMENTS

JP 10-181032 A 7/1998

* cited by examiner

*Primary Examiner* — An Do

(74) *Attorney, Agent, or Firm* — Canon USA Inc IP Division

(57) ABSTRACT

A device substrate includes a substrate body having an energy generating device provided thereon, where the energy generating device generates energy for ejecting liquid, an ejection port forming member disposed on the substrate body, where the ejection port forming member has a pressure chamber that surrounds the energy generating device and an ejection port that communicates with the pressure chamber, and a supply port configured to supply the liquid to the pressure chamber. The ejection port forming member has a first surface that is in contact with the substrate body and a second surface other than the first surface, and the supply port is formed in the second surface.

11 Claims, 12 Drawing Sheets

DEVICE SUBSTRATE, LIQUID EJECTION HEAD, AND METHOD FOR MANUFACTURING DEVICE SUBSTRATE AND LIQUID EJECTION HEAD

BACKGROUND OF THE INVENTION

1. Field of the Invention

The present invention relates to a device substrate including an energy generating device, a liquid ejection head including the device substrate, and a method for manufacturing the device substrate and the liquid ejection head.

2. Description of the Related Art

A liquid ejection head mounted in liquid ejecting apparatuses, such as ink jet recording apparatuses, has been developed. The liquid ejection head ejects liquid from an ejection port using a variety of ways. The liquid ejected from the liquid ejection head is deposited onto a recording medium. In this manner, text and images are printed.

Such a liquid ejection head includes a device substrate having the energy generating device therein. The device substrate includes a substrate body having the energy generating device mounted therein and an ejection port forming member disposed on the substrate body.

The ejection port forming member includes a pressure chamber that surrounds the energy generating device. The ejection port communicates with the pressure chamber. By applying ejection energy to liquid in the pressure chamber using the energy generating device, the liquid is ejected from the ejection port.

Examples of the liquid ejection head and the device substrate are described in Japanese Patent Laid-Open No. 10-181032. A device substrate described in Japanese Patent Laid-Open No. 10-181032 has a supply port formed in a substrate body. The supply port communicates with the pressure chamber.

More specifically, the substrate body has a through-hole formed therein. One of two openings formed at both ends of the through-hole serves as the supply port. The other opening is located in a surface of the substrate body that is in contact with the ejection port forming member. An opening is formed in the ejection port forming member at a position that faces the other opening of the through-hole so that the supply port communicates with the pressure chamber through the opening.

SUMMARY OF THE INVENTION

According to an embodiment of the present invention, a device substrate includes a substrate body having an energy generating device provided thereon, where the energy generating device generates energy for ejecting liquid, at least one ejection port forming member disposed on the substrate body, where the ejection port forming member has a pressure chamber that surrounds the energy generating device and an ejection port that communicates with the pressure chamber, and a supply port configured to supply the liquid to the pressure chamber. The ejection port forming member has a first surface, which is in contact with the substrate body, and a second surface other than the first surface, and the supply port is formed in the second surface.

According to another embodiment of the present invention, a method for manufacturing a device substrate is provided. The device substrate includes a substrate body having an energy generating device provided thereon, where the energy generating device generates energy for ejecting liquid, an ejection port forming member disposed on the substrate body, where the ejection port forming member has a pressure chamber that surrounds the energy generating device and at least one ejection port that communicates with the pressure chamber, and a supply port configured to supply the liquid to the pressure chamber, where the ejection port forming member has a first surface, which is in contact with the substrate body, and a second surface other than the first surface, and the supply port is formed in the second surface. The method includes a mold material forming step of forming a mold material on the substrate body having the energy generating device formed therein between a portion to be formed into the supply port and a portion to be formed into the pressure chamber, an ejection port member forming step of forming the ejection port forming member on the substrate body and the mold material without covering a portion of the mold material to be formed into the supply port, and a supply port forming step of forming the supply port that communicates with the pressure chamber by removing the mold material.

Further features of the present invention will become apparent from the following description of exemplary embodiments with reference to the attached drawings.

DESCRIPTION OF THE EMBODIMENTS

A substrate body having an energy generating device mounted therein is made from a relatively costly member, such as a silicon substrate. Accordingly, to reduce the cost of the device substrate and the liquid ejection head, there is a need for reducing the size of the substrate body.

However, since the device substrate described in Japanese Patent Laid-Open No. 10-181032 includes the substrate body having the supply port formed therein, the size of the substrate body is determined in accordance with the size of the supply port. Since the amount of liquid supplied to the pressure chamber depends on the size of the supply port, it is difficult to reduce the size of the supply port. For this reason, it is difficult to reduce the size of the substrate body of the device substrate described in Japanese Patent Laid-Open No. 10-181032.

Accordingly, the present invention provides a technique for reducing the size of the substrate body without reducing the amount of liquid supplied to the pressure chamber.

Exemplary embodiments of the present invention are described below with reference to the accompanying drawings.

First Exemplary Embodiment

Figure 1A:
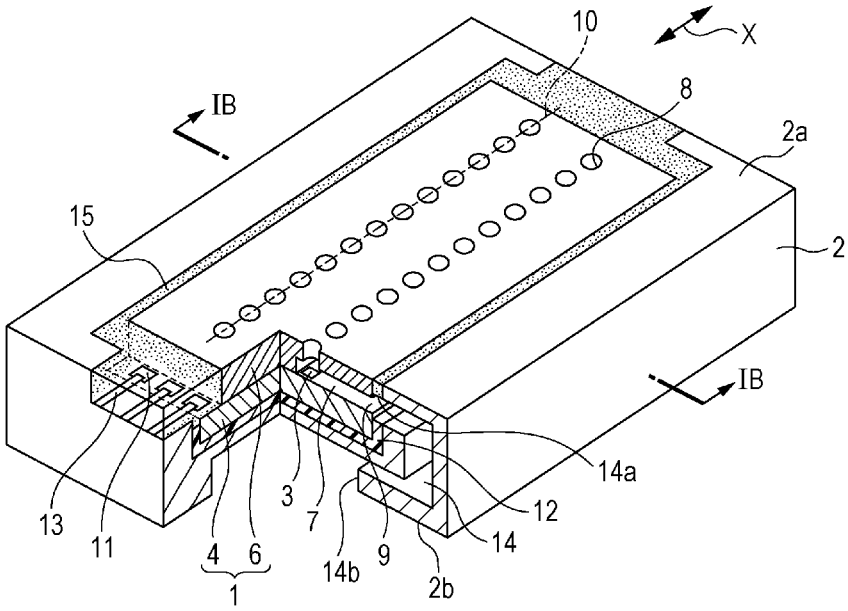
FIG. 1A is a partial perspective, cross-sectional view of a liquid ejection head according to a first exemplary embodiment.
Figure 1B:
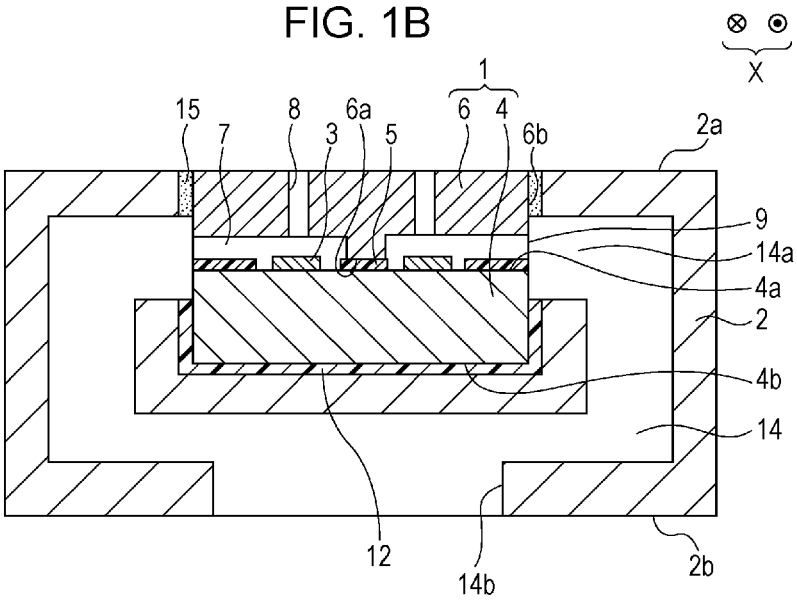
FIG. 1B is a cross-sectional view of the liquid ejection head taken along a line IB-IB of FIG. 1A according to the first exemplary embodiment.

A device substrate and a liquid ejection head according to a first exemplary embodiment of the present invention are described first with reference to FIGS. 1A and 1B. FIG. 1A is a partial perspective, cross-sectional view of the liquid ejection head according to the present exemplary embodiment, and FIG. 1B is a cross-sectional view of the liquid ejection head taken along a line IB-IB of FIG. 1A.

As illustrated in FIGS. 1A and 1B, the liquid ejection head according to the present exemplary embodiment includes a device substrate 1 and a supporting member 2 that supports the device substrate 1. The device substrate 1 includes a substrate body 4 having an energy generating device 3 formed thereon and an ejection port forming member 6 disposed on the substrate body 4 with an intermediate layer 5 therebetween.

The substrate body 4 is made from, for example, a silicon wafer cut out from an ingot formed by causing a growth of seed crystal of a semiconductor material, such as silicon, in a circular cylindrical shape. The intermediate layer 5 is provided to increase adhesion between the substrate body 4 and the ejection port forming member 6. If sufficient adhesion can be obtained even when the ejection port forming member 6 is in direct contact with the substrate body 4, the need for the intermediate layer 5 can be eliminated.

The substrate body 4 is a plate-like member. To reduce the size of the substrate body 4, it is desirable that a supply port 9 for supplying liquid to a pressure chamber 7 (described in more detail below) be not formed in the substrate body 4. For the same reason, it is desirable that a through-hole be not formed in the substrate body 4.

The energy generating device 3 is disposed on a surface of the substrate body 4 having the ejection port forming member 6 thereon. Hereinafter, the surface of the substrate body 4 having the energy generating device 3 thereon is referred to as a "device layout surface 4*a*".

The ejection port forming member 6 includes the pressure chamber 7 that surrounds the energy generating device 3 and an ejection port 8 that communicates with the pressure chamber 7. By applying ejection energy from the energy generating device 3 to the liquid inside the pressure chamber 7, the liquid is ejected from the ejection port 8.

The ejection port forming member 6 has a first surface 6*a* that is in contact with the intermediate layer 5 and a second surface 6*b* other than the first surface 6*a*. The second surface 6*b* has the supply port 9 formed therein. The supply port 9 communicates with the pressure chamber 7. The liquid is supplied to the pressure chamber 7 through the supply port 9.

Note that according to the present exemplary embodiment, the need for the intermediate layer 5 may be eliminated and, thus, the first surface 6*a* may be in direct contact with the substrate body 4.

The number of the ejection ports 8 is plural. The plurality of the ejection ports 8 are arranged in a predetermined direction (hereinafter referred to as an "X direction") to form an ejection port array 10. The length of the ejection port forming member 6 in the X direction is less than the length of the substrate body 4. Both ends of the device layout surface 4*a* in the X direction are not covered by the ejection port forming member 6. In addition, an electric wiring pad 11 is formed at each end.

The second surface 6*b* of the ejection port forming member 6 is adjacent to the first surface 6*a* and extends in the X direction. The supply port 9 is rectangular in shape having a long side direction that is the same as the X direction.

The supporting member 2 has a first surface 2*a* having a concave portion formed therein. The device substrate 1 is disposed in the concave portion. More specifically, a back surface 4*b* that is opposite to the device layout surface 4*a* of the substrate body 4 is adhered to the bottom of the concave portion of the supporting member 2 using an adhesive agent 12.

The first surface 2*a* of the supporting member 2 has a groove formed therein. The groove extends from the concave portion in the X direction. The bottom surface of the groove has an electric wire 13 disposed thereon. The electric wiring pad 11 is electrically connected to the electric wire 13.

The electric wire 13 is electrically connected to a main body of the liquid ejecting apparatus (not illustrated). The electricity generated by the main body of the liquid ejecting apparatus is transferred to the energy generating device 3 via the electric wiring pad 11. Upon receiving the electricity, the energy generating device 3 applies the ejection energy to the liquid. Thus, the liquid is ejected from the ejection port 8.

The supporting member 2 has a flow passage 14 formed therein. The flow passage 14 has two openings. One of the openings that serves as an outlet port is a first flow passage opening 14*a*. The first flow passage opening 14*a* is located in an inner side surface of the concave portion at a position that faces the supply port 9. The flow passage 14 communicates with the supply port 9 via the first flow passage opening 14*a*. The other opening that serves as an inlet port is a second flow passage opening 14*b*. The second flow passage opening 14*b* is formed in a second surface 2*b* that is opposite to the first surface 2*a*.

It is desirable that the first flow passage opening 14*a* be larger than the supply port 9. By making the first flow passage opening 14*a* larger than the supply port 9, the liquid can easily flow from the flow passage 14 to the supply port 9.

A gap formed between the second surface 6*b* of the ejection port forming member 6 and the inner side surface of the concave portion having the first flow passage opening 14*a* formed therein is sealed by using a sealing agent 15. Thus, the liquid does not leak out of the gap. In contrast, the supply port 9 and the first flow passage opening 14*a* are not sealed by the sealing agent 15 and, thus, the flow of the liquid is not disturbed.

The electric wiring pad 11 and the electric wire 13 may be covered by the sealing agent 15. By covering the electric wiring pad 11 and the electric wire 13 by the sealing agent 15, corrosion of the electric wiring pad 11 and the electric wire 13 by the liquid can be prevented.

According to the present exemplary embodiment, since the supply port 9 is formed in the second surface 6*b* of the ejection port forming member 6, the need for reducing the size of the supply port when the size of the substrate body 4 is reduced can be lessened. Accordingly, the size of the substrate body 4 can be reduced without decreasing the amount of liquid supplied to the pressure chamber 7.

In addition, the need for forming the supply port 9 in the substrate body 4 is lessened and, thus, the manufacturing cost of the device substrate 1 can be easily reduced.

Furthermore, if one of both the ends of the through-hole formed in the substrate body 4, such as a silicon wafer, is used as the supply port, air bubbles may be generated in the through-hole. According to the present exemplary embodiment, since the through-hole that serves as a flow passage or the supply port of the liquid is not formed in the substrate body 4, generation of air bubbles can be prevented more.

Still furthermore, if the supply port that communicates with the pressure chamber 7 is formed in the substrate body 4, the length of the flow passage in the ejection port forming member 6 is relatively decreased. As a result, in some cases, the ejection port forming member 6 is not sufficiently cooled by the liquid flowing through the flow passage. In such a case, the temperature of the ejection port forming member 6 increases and, thus, a variation easily occurs in the temperature distribution of the ejection port forming member 6. Accordingly, due to the variation in the temperature distribution of the ejection port forming member 6, the amount of ejected liquid may vary from ejection port to ejection port.

According to the present exemplary embodiment, since the supply port 9 is formed in the second surface 6*b* of the ejection port forming member 6, the flow passage in the ejection port forming member 6 is relatively long. Accordingly, the period of time during which the liquid is in contact with the ejection port forming member 6 is relatively long and, thus, the ejection port forming member 6 is sufficiently cooled. As a result, the variation in the temperature distribution of the ejection port forming member 6 is reduced and, thus, the variation in the amount of ejected liquid from ejection port to ejection port can be reduced.

Figure 2A:
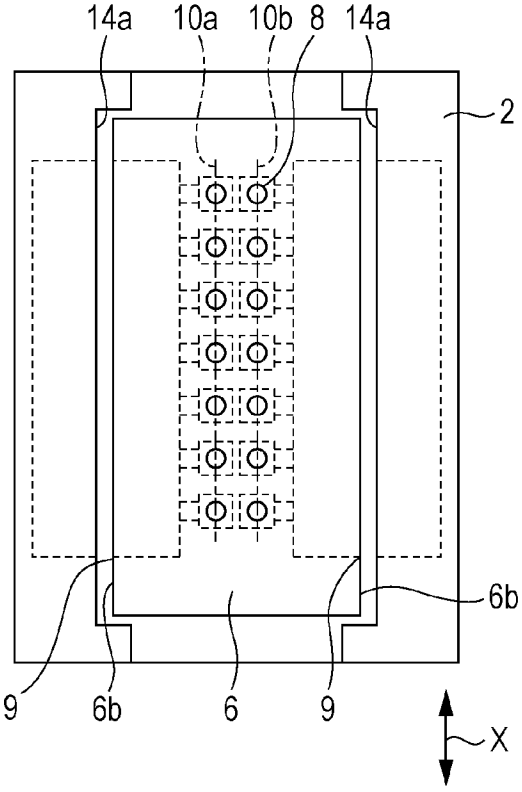
FIGS. 2A to 2C are top views of liquid ejection heads according to the first exemplary embodiment.
Figure 2B:
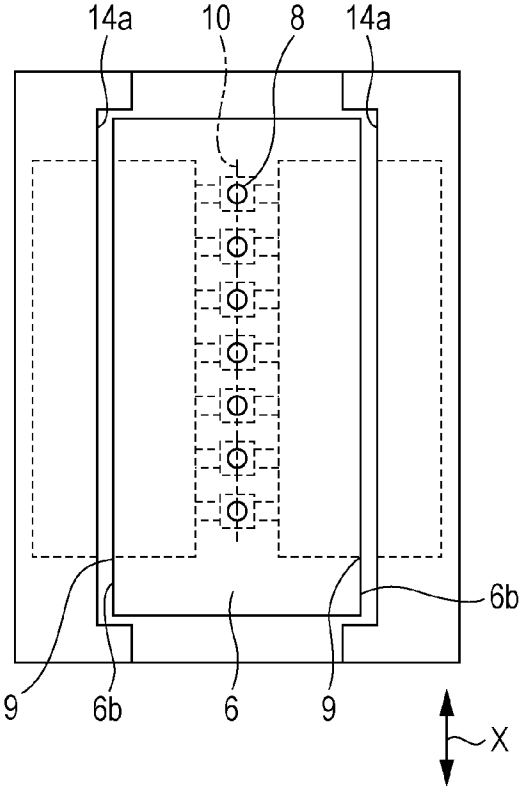
Figure 2C:
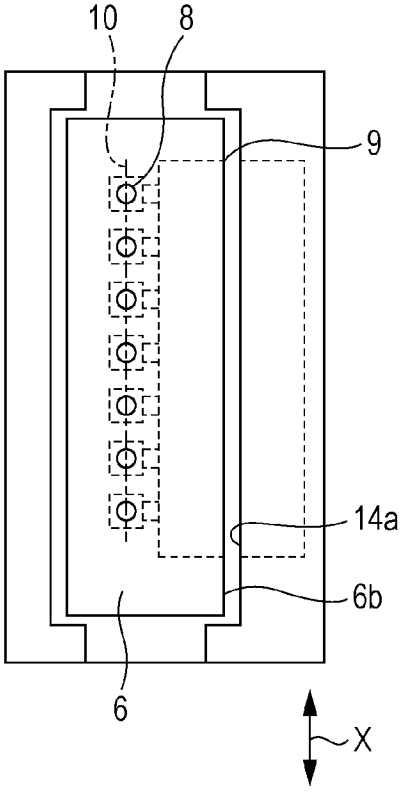

Several particular examples of the liquid ejection head are described below with reference to FIGS. 2A to 2C. FIG. 2A is a top view of a liquid ejection head illustrated in FIGS. 1A and 1B. FIGS. 2B and 2C are top views of liquid ejection heads that differ from that illustrated in FIGS. 1A and 1B.

In the example illustrated in FIG. 2A, two ejection port arrays 10*a* and 10*b* are formed. In addition, a supply port 9 is formed in each of the two second surfaces 6*b* that are adjacent to the first surface 6*a* of the ejection port forming member 6 (refer to FIGS. 1A and 1B) and that extend in the X direction. One of the supply ports 9 communicates with an ejection port 8 of the ejection port array 10*a*, and the other supply port 9 communicates with an ejection port 8 of the ejection port array 10*b*.

In addition, the first flow passage opening 14*a* is formed in each of two of the inner side surfaces of the concave portion of the supporting member 2 that face the supply ports 9. Accordingly, the liquid is supplied from one of the first flow passage openings 14*a* to the ejection port 8 of the ejection port array 10*a*, and the liquid is supplied from the other first flow passage opening 14*a* to the ejection port 8 of the ejection port array 10*b*.

In this example, a relatively large number of the ejection ports 8 can be provided. Accordingly, a large amount of liquid can be ejected in a short time.

In the example illustrated in FIG. 2B, only one ejection port array 10 is formed. A supply port 9 is formed in each of the two second surfaces 6*b* that are adjacent to the first surface 6*a* of the ejection port forming member 6 (refer to FIGS. 1A and 1B) and that extend in the X direction. Both the supply ports 9 communicate with the ejection ports 8 of the ejection port array 10.

In addition, the first flow passage opening 14*a* is formed in each of two of the inner side surfaces of the concave portion of the supporting member 2 that face the supply ports 9. Accordingly, the liquid is supplied from the two first flow passage openings 14*a* to each of the ejection ports 8 of the ejection port array 10.

In this example, since the two supply ports 9 communicate with each of the ejection ports 8, a more amount of the liquid can be easily supplied to the ejection port 8.

In the example illustrated in FIG. 2C, only one ejection port array 10 is formed. In addition, a supply port 9 is formed in only one of two second surfaces 6*b* that are adjacent to the first surface 6*a* of the ejection port forming member 6 (refer to FIG. 1) and that extend in the X direction. Furthermore, one supply port 9 communicates with each of the ejection ports 8 of the ejection port array 10.

Still furthermore, the first flow passage opening 14*a* is formed in only one of the inner side surfaces of the concave portion of the supporting member 2 that faces the supply port 9. Accordingly, the liquid is supplied from only one of the first flow passage openings 14*a* to the ejection port 8 of the ejection port array 10.

In this example, since only one supply port 9 is formed in the ejection port forming member 6, the size of the ejection port forming member 6 can be reduced more. As a result, the size of the device substrate 1 (refer to FIGS. 1A and 1B) can be reduced more.

A method for manufacturing the device substrate 1 and a method for manufacturing the liquid ejection head including the device substrate 1 are described below with reference to FIGS. 3A to 3E, FIGS. 4A to 4E, FIGS. 5A to 5E, FIGS. 6A to 6C, and FIGS. 7A and 7B. FIGS. 3A to 3E are cross-sectional views illustrating manufacturing steps of the device substrate 1.

Figure 3A:
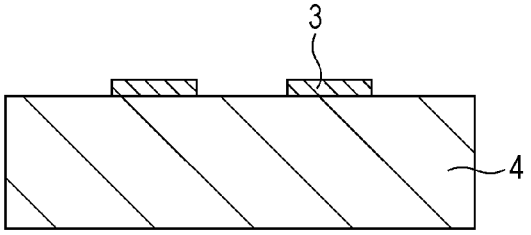
FIGS. 3A to 3E are cross-sectional views illustrating the steps for manufacturing the device substrate illustrated in FIGS. 1A and 1B.
Figure 3B:
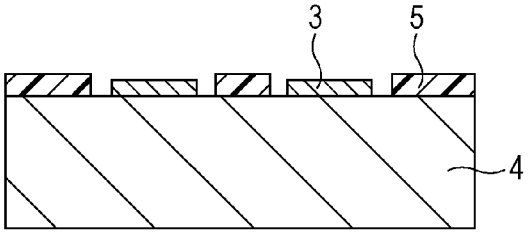

As illustrated in FIG. 3A, to manufacture the device substrate 1, the energy generating device 3 and a logic circuit (not illustrated) are disposed on the substrate body 4 first. Subsequently, as illustrated in FIG. 3B, the intermediate layer 5 is formed on the substrate body 4 (an intermediate layer forming step).

The intermediate layer 5 is formed of a thermoplastic resin material. More specifically, the thermoplastic resin material is applied onto the substrate body 4 by a spin coat technique first. Thereafter, the thermoplastic resin material is baked in an oven and, thus, is cured. Thereafter, the cured thermoplastic resin material is selectively removed by dry etching technique. In this manner, the intermediate layer 5 is formed.

According to the present exemplary embodiment, the intermediate layer 5 is formed so as to have a thickness of 2 μm. For example, a polyetheramide resin, such as HIMAL-1 available from Hitachi Chemical Co., Ltd, can be used as the thermoplastic resin material.

Figure 3C:
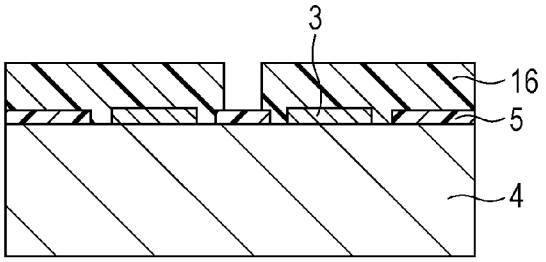

After the intermediate layer forming step is completed, a mold material 16 is formed between a portion to be formed into the supply port 9 (refer to FIGS. 1A and 1B) and a portion to be formed into the pressure chamber 7 (refer to FIGS. 1A and 1B), as illustrated in FIG. 3C (a mold material forming step). The mold material 16 is formed of a positive photosensitive resin material that is dissoluble. More specifically, the dissoluble positive photosensitive resin material is applied to the substrate body 4, the energy generating device 3, and the intermediate layer 5 using a spin coat technique. Thereafter, by selectively exposing and developing the positive photosensitive resin material, the mold material 16 is formed.

According to the present exemplary embodiment, the mold material 16 is formed so as to have a thickness of 18 μm from the substrate body 4. For example, a positive Deep-UV resist (e.g., ODUR available from Tokyo Ohka Kogyo Co., Ltd.) can be used as the dissoluble positive photosensitive resin material.

Figure 3D:
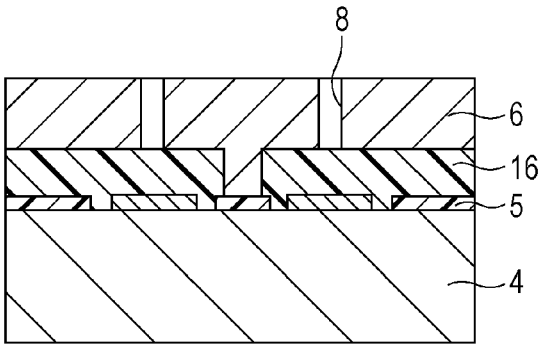

After the mold material forming step is completed, the ejection port forming member 6 is formed on the intermediate layer 5 and the mold material 16, as illustrated in FIG. 3D (an ejection port member forming step). At that time, a portion of the mold material 16 to be formed into the supply port 9 is not covered by the ejection port forming member 6. In addition, in the ejection port member forming step, the ejection port 8 is formed.

The ejection port forming member 6 and the ejection port 8 are formed of a negative photosensitive resin material. More specifically, the negative photosensitive resin material is applied to the intermediate layer 5 and the mold material 16 using a spin coat technique. Thereafter, the photosensitive resin material is selectively exposed and developed. Subsequently, the photosensitive resin material is cured in an oven at a temperature of 140° C. for 60 minutes. In this manner, the ejection port forming member 6 is formed.

According to the present exemplary embodiment, the ejection port forming member 6 is formed so as to have a thickness of 70 μm from the intermediate layer 5. For example, an epoxy resin (e.g., EHPE-3170 available from Daicel Corporation) can be used as the negative photosensitive resin material.

Figure 3E:
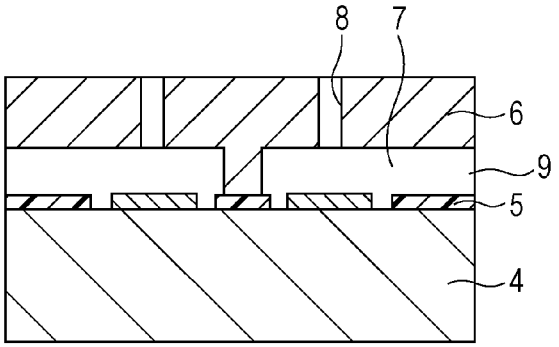

By removing the mold material 16 after the ejection port member forming step is completed, the pressure chamber 7 and the supply port 9 are formed (a supply port forming step, refer to FIG. 3E). According to the present exemplary embodiment, the mold material 16 is soaked in methyl lactate having a temperature heated and maintained at 40° C., and ultrasonic waves of 200 kHz and 200 W are applied to methyl lactate. In this manner, the mold material 16 is eluted to form the pressure chamber 7 and the supply port 9.

Through the above-described steps, the device substrate 1 is accomplished.

Note that according to the present exemplary embodiment, in order to increase adhesiveness between the substrate body 4 and the ejection port forming member 6, the intermediate layer 5 is formed. If sufficient adhesiveness is maintained even when the substrate body 4 is in direct contact with the ejection port forming member 6, the need for forming the intermediate layer 5 can be eliminated.

FIGS. 4A to 4E are cross-sectional views illustrating the manufacturing steps of the supporting member 2 (refer to FIGS. 1A and 1B). In FIGS. 4A to 4E, a method for manufacturing the supporting member 2 by stacking five constituent members is illustrated.

Figure 4A:
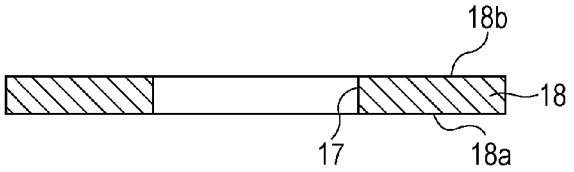
FIGS. 4A to 4E are cross-sectional views illustrating the steps for manufacturing a supporting member illustrated in FIGS. 1A and 1B.
Figure 5A:
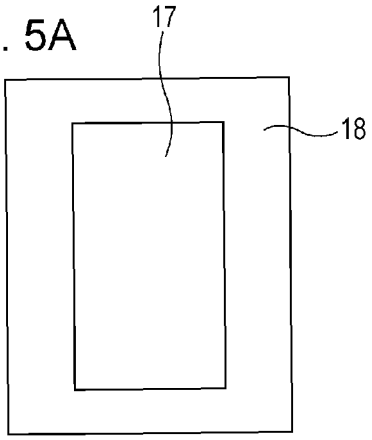
FIGS. 5A to 5E are top views of constituent members used for manufacturing the supporting member.

To manufacture the supporting member 2 (refer to FIGS. 1A and 1B), as illustrated in FIG. 4A, a first constituent member 18 having a first through-hole 17 formed therein is prepared first. The first through-hole 17 serves as the second flow passage opening 14*b*. FIG. 5A is a top view of the first constituent member 18.

Among the surfaces of the first constituent member 18, a surface 18*a* in which one of two openings at both ends of the first through-hole 17 is located serves as the second surface 3*b* of the supporting member 2 (refer to FIGS. 1A and 1B). According to the present exemplary embodiment, the thickness of the first constituent member 18 is set to 1000 μm.

Figure 4B:
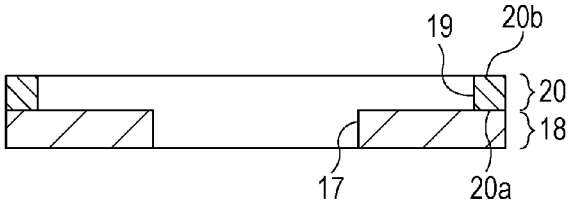
Figure 5B:
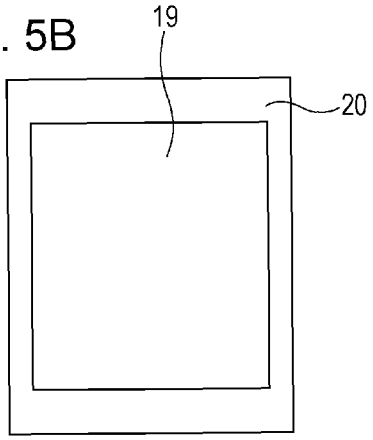

Subsequently, as illustrated in FIG. 4B, a second constituent member 20 having a second through-hole 19 formed therein is formed on a surface 18*b* of the first constituent member 18 in which the other opening of the first through-hole 17 is located. FIG. 5B is a top view of the second constituent member 20.

The second through-hole 19 passes through the second constituent member 20 from a surface 20*a* of the second constituent member 20 that is in contact with the first constituent member 18 to a surface 20*b* that is opposite to the surface 20*a*. The second through-hole 19 communicates with the first through-hole 17. According to the present exemplary embodiment, the thickness of the second constituent member 20 is set to 1000 μm.

Figure 4C:
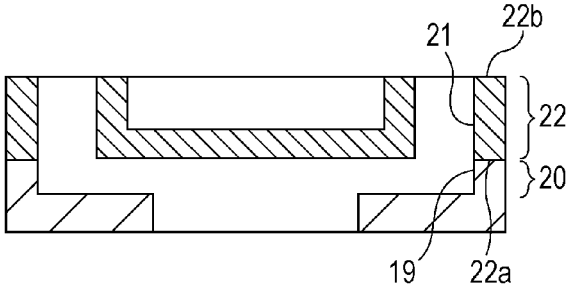
Figure 5C:
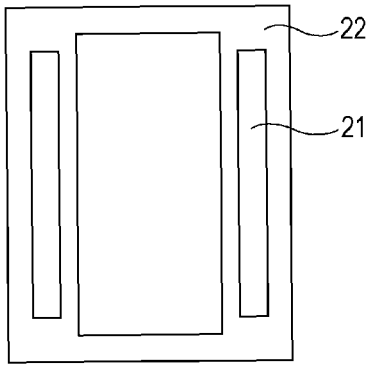

Subsequently, as illustrated in FIG. 4C, a third constituent member 22 having a third through-hole 21 formed therein is formed on the surface 20*b* of the second constituent member 20. FIG. 5C is a top view of the third constituent member 22.

The third constituent member 22 has a portion that serves as a bottom portion of the concave portion of the supporting member 2 (refer to FIGS. 1A and 1B). The third through-hole 21 passes through the third constituent member 22 from a surface 22*a* of the third constituent member 22 that is in contact with the second constituent member 20 to a surface 22*b* that is opposite to the surface 22*a*. The third through-hole 21 communicates with the second through-hole 19. According to the present exemplary embodiment, the thickness of the third constituent member 22 is set to 1000 μm.

Figure 4D:
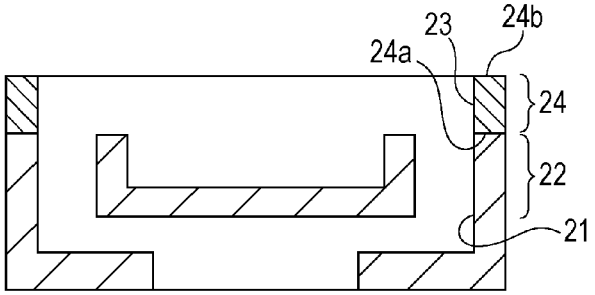
Figure 5D:
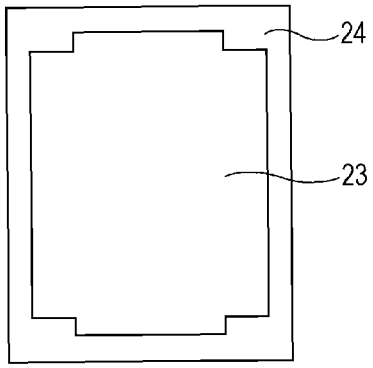

Subsequently, as illustrated in FIG. 4D, a fourth constituent member 24 having a fourth through-hole 23 formed therein is formed on the surface 22*b* of the third constituent member 22. FIG. 5D is a top view of the fourth constituent member 24.

The fourth through-hole 23 passes through the fourth constituent member 24 from a surface 24*a* of the fourth constituent member 24 that is in contact with the third constituent member 22 to a surface 24*b* that is opposite to the surface 24*a*. The fourth through-hole 23 communicates with the third through-hole 21.

In addition, the fourth through-hole 23 is located above the portion serving as a bottom portion of the concave portion of the supporting member 2 (refer to FIGS. 1A and 1B). That is, part of the fourth through-hole 23 serves as part of the concave portion of the supporting member 2. According to the present exemplary embodiment, the thickness of the fourth constituent member 24 is set to 250 μm.

Figure 4E:
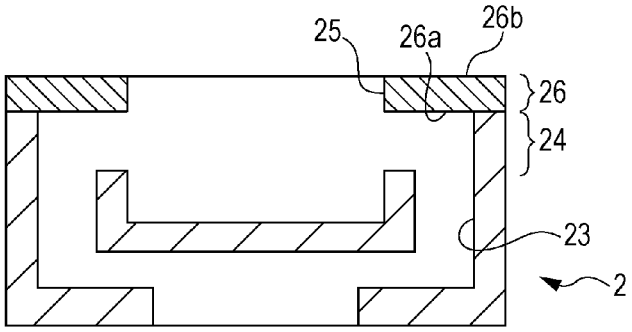
Figure 5E:
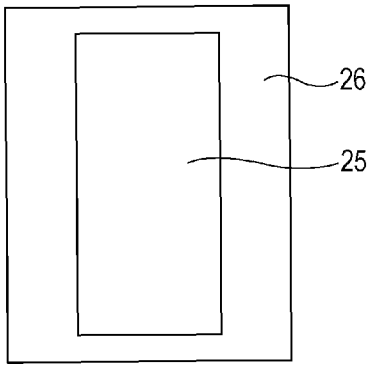

After the fourth constituent member 24 is formed, a fifth constituent member 26 having a fifth through-hole 25 formed therein is formed on the surface 24*b* of the fourth constituent member 24, as illustrated in FIG. 4E. FIG. 5E is a top view of the fifth constituent member 26.

The fifth through-hole 25 passes through the fifth constituent member 26 from a surface 26*a* of the fifth constituent member 26 that is in contact with the fourth constituent member 24 to a surface 26*b* that is opposite to the surface 26*a*. In addition, the fifth through-hole 25 is located only above a portion of the supporting member 2 (refer to FIGS. 1A and 1B) serving as the bottom portion of the concave portion of the supporting member 2. That is, part of the fifth through-hole 25 serves as part of the concave portion of the supporting member 2, and the surface 26*b* of the fifth constituent member 26 serves as the first surface 2*a* of the supporting member 2 (refer to FIGS. 1A and 1B). According to the present exemplary embodiment, the thickness of the fifth constituent member 26 is set to 50 μm.

Through the above-described steps, the supporting member 2 is accomplished. Note that the first to fifth constituent members 18, 20, 22, 24, and 26 may be stacked to form a laminate body. Thereafter, the laminate body may be fired to form one member integrated with the supporting member 2.

It is desirable that the first to fifth constituent members 18, 20, 22, 24, and 26 be made of a material having resistance to ink and allowing the device substrate 1 (refer to FIGS. 1A and 1B) to be adhered thereto, and it is more desirable that the first to fifth constituent members 18, 20, 22, 24, and 26 be made of a material having a coefficient of linear expansion that is substantially the same as that of the substrate body 4 (refer to FIGS. 1A and 1B) and having a thermal conductivity that is substantially the same as that of the substrate body 4 or higher.

While the present exemplary embodiment has been described with reference to the first to fifth constituent members 18, 20, 22, 24, and 26 made of alumina (oxidized aluminum), the material of the supporting member 2 is not limited thereto. For example, the supporting member 2 may be formed of, for example, silicon (Si), aluminum nitride (AlN), zirconia ($ZrO_2$), silicon nitride ($Si_3N_4$), silicon carbide (SiC), molybdenum (Mo), or tungsten (W).

Figure 6A:
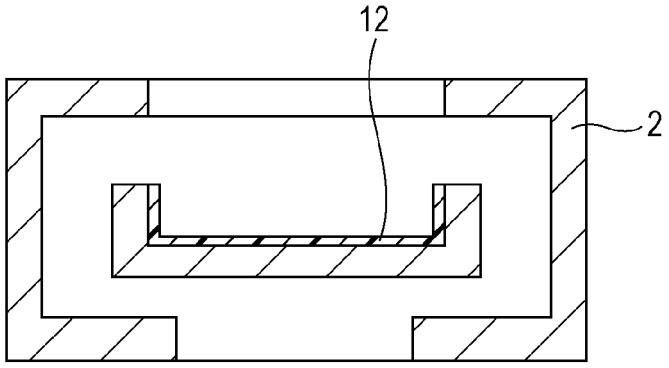
FIGS. 6A to 6C are cross-sectional views illustrating the steps for attaching the device substrate to the supporting member.
Figure 6B:
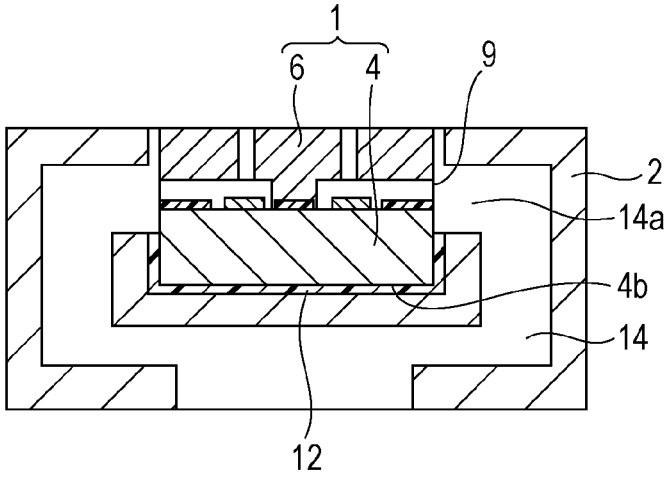
Figure 6C:
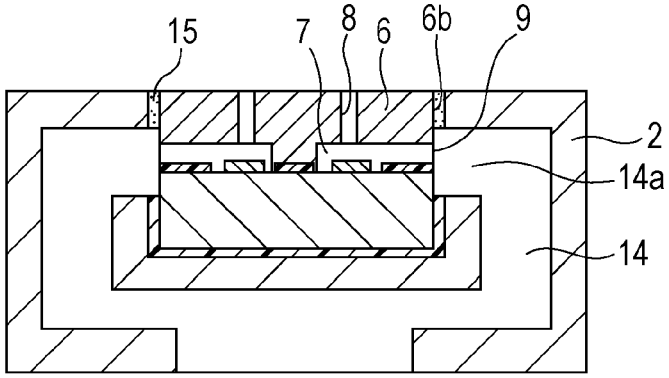

FIGS. 6A to 6C are cross-sectional views illustrating steps for attaching the device substrate 1 to the supporting member 2.

As illustrated in FIG. 6A, the adhesive agent 12 is applied to the bottom of the concave portion of the supporting member 2 first. According to the present exemplary embodiment, the adhesive agent 12 is applied to a region of the bottom in which the back surface 4*b* (refer to FIGS. 1A and 1B) of the substrate body 4 is to be placed. A thermosetting resin material, such as epoxy resin, can be used as the adhesive agent 12.

Subsequently, as illustrated in FIG. 6B, the device substrate 1 is disposed in the concave portion of the supporting member 2. At that time, the back surface 4*b* of the substrate body 4 is fixed to the bottom of the concave portion of the supporting member 2 using the adhesive agent 12. The supply port 9 faces the first flow passage opening 14*a*, and the flow passage 14 communicates with the supply port 9.

Subsequently, as illustrated in FIG. 6C, a gap formed between the second surface 6*b* of the ejection port forming member 6 and the inner side surface of the concave portion of the supporting member 2 is filled with the sealing agent 15. By sealing the gap with the sealing agent 15, the liquid is supplied from the flow passage 14 to the supply port 9 without leaking out through the gap and is ejected from the ejection port 8.

According to the present exemplary embodiment, the gap between the ejection port forming member 6 and the supporting member 2 is filled with the sealing agent 15 using a capillary phenomenon. More specifically, an adequate amount of the sealing agent 15 is applied to a portion in the vicinity of the gap and is left for a predetermined amount of time. Due to a capillary phenomenon, the sealing agent 15 enters the gap, and the gap is filled with the sealing agent 15. By adjusting the amount of the sealing agent 15 applied, the sealing agent 15 seals the gap without sealing the supply port 9 and the first flow passage opening 14*a*.

Through the above-described steps, the device substrate 1 is attached to the supporting member 2. Thus, the liquid ejection head is accomplished.

Second Exemplary Embodiment

A device substrate and a liquid ejection head according to a second exemplary embodiment of the present invention are described with reference to FIGS. 7A and 7B. Note that the same numbering will be used in referring to elements in FIGS. 7A and 7B as is utilized above in the first exemplary embodiment, and descriptions of the elements are not repeated.

Figure 7A:
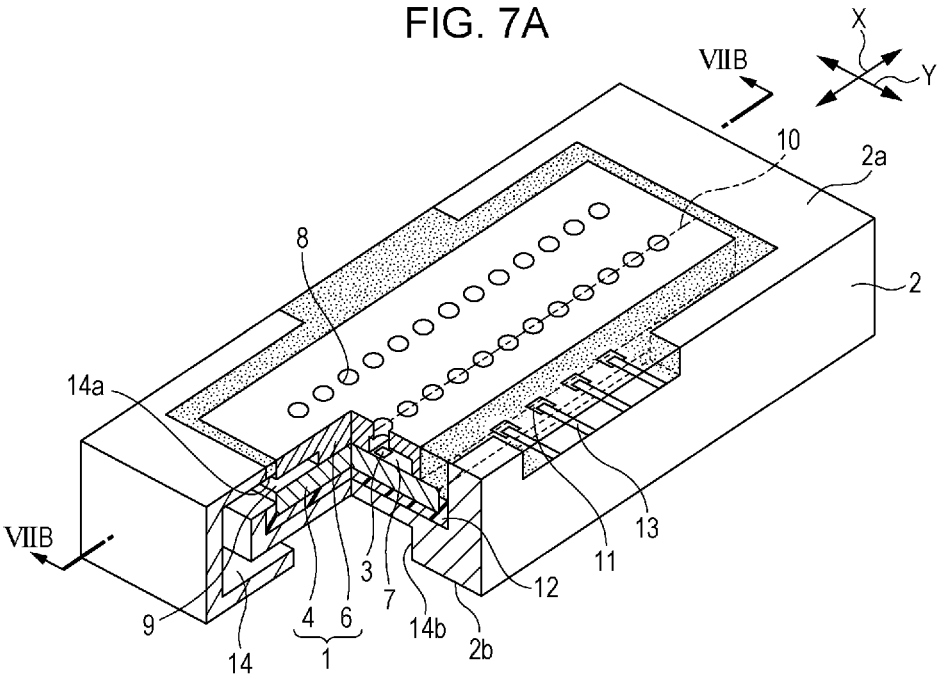
FIG. 7A is a partial perspective, cross-sectional view of a liquid ejection head according to a second exemplary embodiment.
Figure 7B:
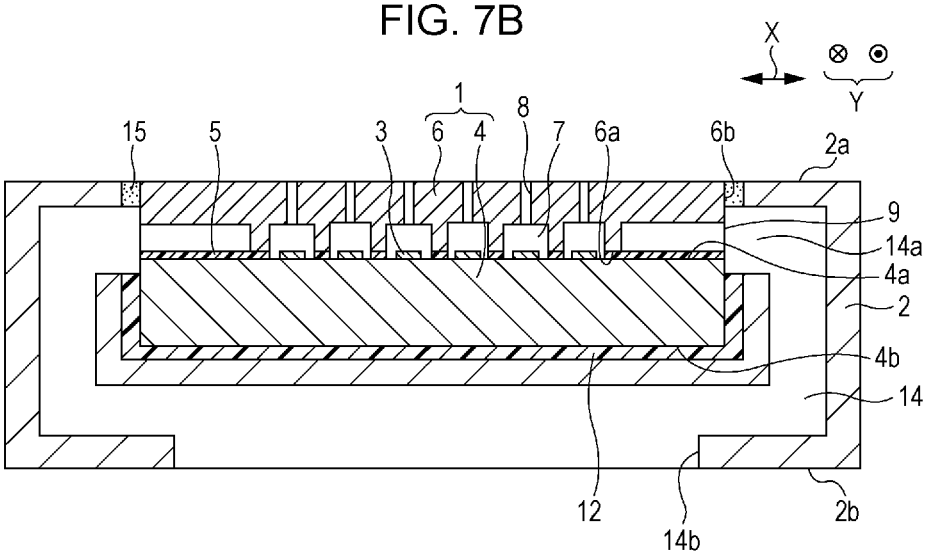
FIG. 7B is a cross-sectional view of the liquid ejection head taken along a line VIIB-VIIB of FIG. 7A according to a second exemplary embodiment.

FIG. 7A is a partial perspective, cross-sectional view of the liquid ejection head according to the present exemplary embodiment, and FIG. 7B is a cross-sectional view of the liquid ejection head taken along a line VIIB-VIIB of FIG. 7A.

As illustrated in FIGS. 7A and 7B, the second surface 6*b* having the supply port 9 formed therein is adjacent to the first surface 6*a* and intersects with the X direction. In addition, the supply port 9 is rectangular in shape that extends in a Y-direction in which the ejection port array 10 extends.

The length of the ejection port forming member 6 is smaller than the length of the substrate body 4 in the Y-direction. Both ends of the device layout surface 4*a* in the Y-direction are not covered by the ejection port forming member 6. In addition, an electric wiring pad 11 is formed at each end.

The first surface 2*a* of the supporting member 2 has a groove formed therein. The groove extends from the concave portion in the Y-direction. In addition, an electric wire 13 is disposed in the bottom of the groove. The electric wiring pad 11 is electrically connected to the electric wire 13.

According to the present exemplary embodiment, since the supply port 9 is formed in the second surface 6*b* of the ejection port forming member 6, the need for reducing the size of the supply port when the size of the substrate body 4 is reduced can be lessened. Accordingly, the size of the substrate body 4 can be reduced without decreasing the amount of liquid supplied to the pressure chamber 7.

In addition, the need for forming the supply port 9 in the substrate body 4 is lessened and, thus, the manufacturing cost of the device substrate 1 can be easily reduced.

Furthermore, if one of both the ends of the through-hole formed in the substrate body 4, such as a silicon wafer, is used as the supply port, air bubbles may be generated in the through-hole. According to the present exemplary embodiment, since the through-hole that serves as a flow passage of the liquid or the supply port is not formed in the substrate body 4, generation of air bubbles can be prevented more.

Still furthermore, if the supply port that communicates with the pressure chamber 7 is formed in the substrate body 4, the length of the flow passage in the ejection port forming member 6 may be relatively decreased. As a result, the ejection port forming member 6 is not sufficiently cooled by the liquid flowing through the flow passage. In such a case, the temperature of the ejection port forming member 6 increases and, thus, a variation easily occurs in the temperature distribution of the ejection port forming member 6. Accordingly, due to the variation in the temperature distribution of the ejection port forming member 6, the amount of ejected liquid may vary from ejection port to ejection port.

According to the present exemplary embodiment, since the supply port 9 is formed in the second surface 6*b* of the ejection port forming member 6, the flow passage in the ejection port forming member 6 is relatively long. Accordingly, the period of time during which the liquid is in contact with the ejection port forming member 6 is relatively long and, thus, the ejection port forming member 6 is sufficiently cooled. As a result, the variation in the temperature distribution of the ejection port forming member 6 is reduced and, thus, the variation in the amount of ejected liquid from ejection port to ejection port can be reduced.

Figure 8A:
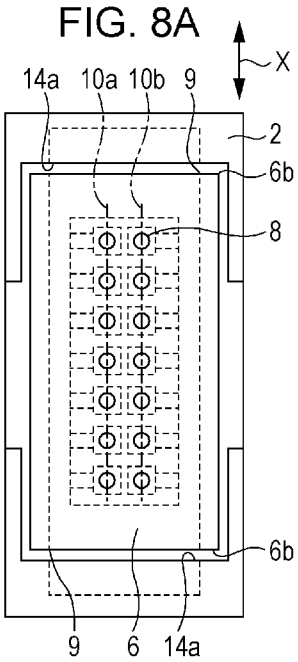
FIGS. 8A to 8D are top views of liquid ejection heads according to the second exemplary embodiment.
Figure 8B:
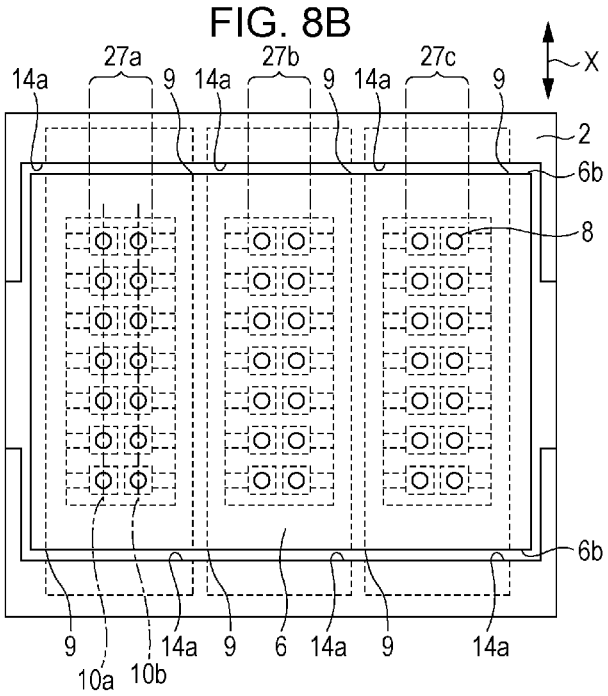
Figure 8C:
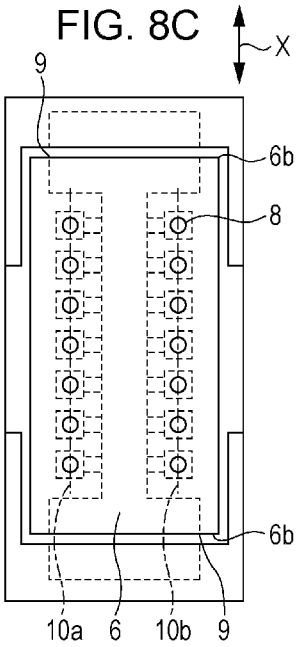
Figure 8D:
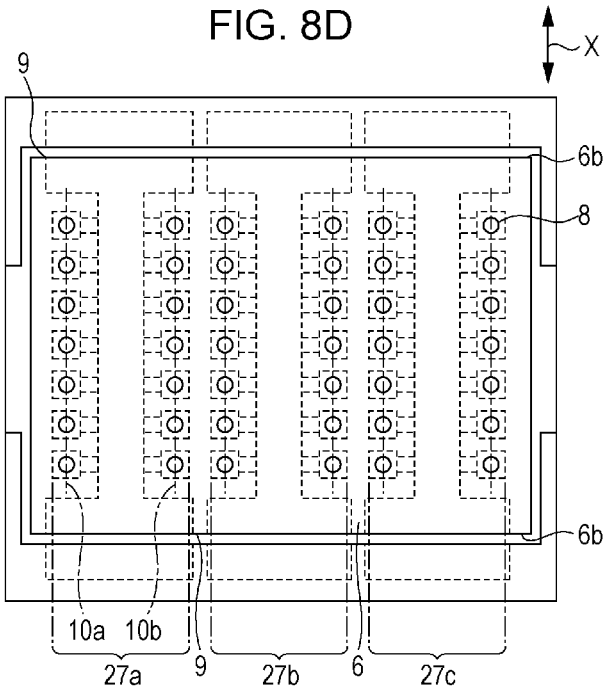

Several particular examples of the liquid ejection head are described below with reference to FIGS. 8A to 8D. FIG. 8A is a top view of a liquid ejection head illustrated in FIGS. 7A and 7B. FIGS. 8B, 8C, and 8D are top views of liquid ejection heads that differ from that illustrated in FIGS. 7A and 7B.

In the example illustrated in FIG. 8A, two ejection port arrays 10*a* and 10*b* are formed. In addition, a supply port 9 is formed in each of two first surfaces 7*b* that are adjacent to the first surface 6*a* of the ejection port forming member 6 (refer to FIGS. 1A and 1B) and that intersect the X direction.

A flow passage that communicates with one of the supply ports 9 and the other supply port 9 is formed around each of the ejection port arrays 10*a* and 10*b*. In addition, the flow passage communicates with the ejection port 8. Accordingly, the two supply ports 9 communicate with the ejection port 8.

In this example, a flow passage need not be formed between the ejection port arrays 10*a* and 10*b*. Thus, the distance between the ejection port arrays 10*a* and 10*b* can be reduced.

In the example illustrated in FIG. 8B, the ejection ports 8 are classified into three ejection port groups 27*a*, 27*b*, and 27*c*. Each of the ejection port groups 27*a*, 27*b*, and 27*c* includes two ejection port arrays 10*a* and 10*b*.

Three supply ports 9 are formed in each of two second surfaces 6*b* that are adjacent to the first surface 6*a* of the ejection port forming member 6 (refer to FIGS. 1A and 1B) and that intersect the X direction. A flow passage that communicates with one of the three supply ports 9 formed in one of the two second surfaces 6*b* and one of the three supplying ports formed in the other second surface 6*b* is formed around the ejection port group 27*a*. In addition, the flow passage communicates with the ejection ports 8 of the ejection port group 27*a*.

Like the flow passage formed around the ejection port group 27*a*, another flow passage is formed around the ejection port group 27*b*. The flow passage communicates with the ejection ports 8 of the ejection port group 27*b*. Furthermore, another flow passage is formed around the ejection port group 27*c*. The flow passage communicates with the ejection ports 8 of the ejection port group 27*c*.

In this example, a flow passage need not be formed between the two ejection port arrays 10*a* and 10*b* included in each of the ejection port groups 27*a*, 27*b*, and 27*c*. Thus, the distance between the ejection port arrays 10*a* and 10*b* can be reduced. In addition, since the ejection ports 8 of the ejection port groups 27*a*, 27*b*, and 27*c* communicate with different supply ports 9, the ejection ports 8 in the device substrate 1 can eject different types of liquid (e.g., ink of different colors).

In the example illustrated in FIG. 8C, two ejection port arrays 10*a* and 10*b* are formed. In addition, a supply port 9 is formed in each of two second surfaces 6*b* that are adjacent to the first surface 6*a* of the ejection port forming member 6 (refer to FIGS. 1A and 1B) and that intersect the X direction.

A flow passage that communicates with one of the two supply ports 9 and the other supply port 9 is formed between the ejection port arrays 10*a* and 10*b*. In addition, the flow passage communicates with the ejection port 8 of each of the ejection port arrays 10*a* and 10*b*. Accordingly, the two supply ports 9 communicate with all of the ejection ports 8.

In this example, since a flow passage that extends between the ejection port arrays 10*a* and 10*b* communicates with all the ejection ports 8, a difference between the amount of liquid supplied to the ejection port 8 of the ejection port array 10*a* and the amount of liquid supplied to the ejection port 8 of the ejection port array 10*b* can be reduced.

In the example illustrated in FIG. 8D, the ejection ports 8 are classified into three ejection port groups 27*a*, 27*b*, and 27*c*. Each of the ejection port groups 27*a*, 27*b*, and 27*c* includes two ejection port arrays 10*a* and 10*b*.

Three supply ports 9 are formed in each of two second surfaces 6*b* that are adjacent to the first surface 6*a* of the ejection port forming member 6 (refer to FIGS. 1A and 1B) and that intersect the X direction. A flow passage that communicates with one of the three supply ports 9 formed in one of the two second surfaces 6*b* and one of the three supplying ports formed in the other second surface 6*b* is formed between the two ejection port arrays 10*a* and 10*b* of the ejection port group 27*a*. In addition, the flow passage communicates with the ejection port 8 of the ejection port group 27*a*.

Like the flow passage formed between the ejection port arrays 10*a* and 10*b* of the ejection port group 27*a*, another flow passage is formed between the ejection port arrays 10*a* and 10*b* of the ejection port group 27*b*. The flow passage communicates with the ejection port 8 of the ejection port group 27*b*. Furthermore, another flow passage is formed between the ejection port arrays 10*a* and 10*b* of the ejection port group 27*c*. The flow passage communicates with the ejection port 8 of the ejection port group 27*c*.

In this example, since in each of the ejection port groups 27*a*, 27*b*, and 27*c*, a flow passage extending between the ejection port arrays 10*a* and 10*b* communicates with an ejection ports 8 of the ejection port arrays 10*a* and 10*b*. Accordingly, a difference between the amount of liquid supplied to the ejection port 8 of the ejection port array 10*a* and the amount of liquid supplied to the ejection port 8 of the ejection port array 10*b* can be reduced. In addition, since the ejection ports 8 of the ejection port groups 27*a*, 27*b*, and 27*c* communicate with different supply ports 9, the ejection ports 8 in the device substrate 1 can eject different types of liquid (e.g., ink of different colors).

A method for manufacturing the device substrate 1 and the liquid ejection head including the device substrate 1 is described below with reference to FIGS. 9A to 9E, FIGS. 10A to 10E, FIGS. 11A to 11E, and FIGS. 12A to 12C. FIGS. 9A to 9E are cross-sectional views illustrating steps for manufacturing the device substrate 1.

Figure 9A:
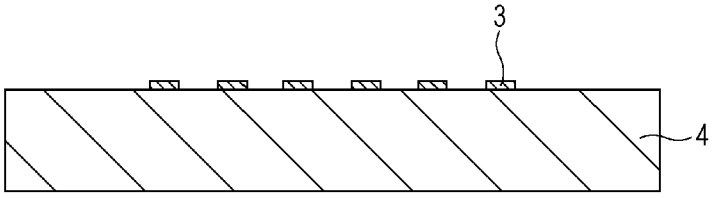
FIGS. 9A to 9E are cross-sectional views illustrating the steps for manufacturing the device substrate illustrated in FIGS. 8A to 8D.
Figure 9B:
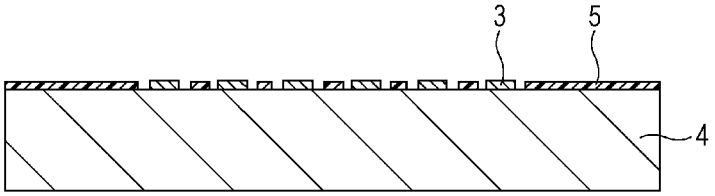

As illustrated in FIG. 9A, to manufacture the device substrate 1, an energy generating device 3 and a logic circuit (not illustrated) are disposed on the substrate body 4 first. Subsequently, as illustrated in FIG. 9B, an intermediate layer 5 is formed on the substrate body 4.

The intermediate layer 5 is formed of a thermoplastic resin material. More specifically, the thermoplastic resin material is applied onto the substrate body 4 by a spin coat technique first. Thereafter, the thermoplastic resin material is baked in an oven and, thus, is cured. Thereafter, the cured thermoplastic resin material is selectively removed by dry etching technique. In this manner, the intermediate layer 5 is formed (an intermediate layer forming step).

According to the present exemplary embodiment, the intermediate layer 5 is formed so as to have a thickness of 2 μm. For example, a polyetheramide resin, such as HIMAL-1 available from Hitachi Chemical Co., Ltd, can be used as the thermoplastic resin material.

Figure 9C:
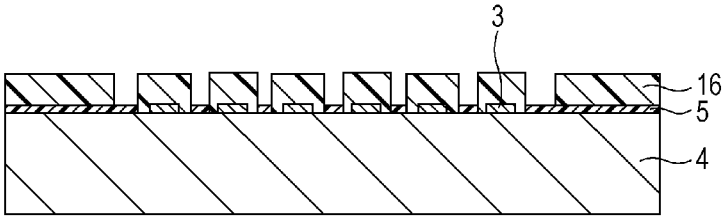

After the intermediate layer forming step is completed, a mold material 16 is formed between a portion to be formed into the supply port 9 (refer to FIGS. 1A and 1B) and a portion to be formed into the pressure chamber 7 (refer to FIGS. 1A and 1B), as illustrated in FIG. 9C (a mold material forming step). The mold material 16 is formed of a positive photosensitive resin material that is dissoluble. More specifically, the dissoluble positive photosensitive resin material is applied to the substrate body 4, the energy generating device 3, and the intermediate layer 5 using a spin coat technique. Thereafter, by selectively exposing and developing the positive photosensitive resin material, the mold material 16 is formed.

According to the present exemplary embodiment, the mold material 16 is formed so as to have a thickness of 18 μm from the substrate body 4. For example, a positive Deep-UV resist (e.g., ODUR available from Tokyo Ohka Kogyo Co., Ltd.) can be used as the dissoluble positive photosensitive resin material.

Figure 9D:
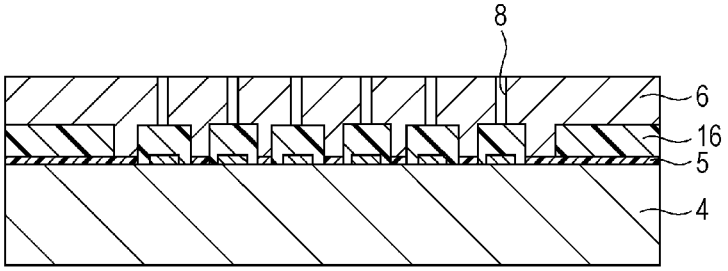

After the mold material forming step is completed, the ejection port forming member 6 is formed on the intermediate layer 5 and the mold material 16, as illustrated in FIG. 9D (an ejection port member forming step). At that time, a portion of the mold material 16 to be formed into the supply port 9 is not covered by the ejection port forming member 6. In addition, in the ejection port member forming step, the ejection port 8 is formed.

The ejection port forming member 6 and the ejection port 8 are formed of a negative photosensitive resin material. More specifically, the negative photosensitive resin material is applied to the intermediate layer 5 and the mold material 16 using a spin coat technique. Thereafter, the photosensitive resin material is selectively exposed and developed. Subsequently, the photosensitive resin material is cured in an oven at a temperature of 140° C. for 60 minutes. In this manner, the ejection port forming member 6 is formed.

According to the present exemplary embodiment, the ejection port forming member 6 is formed so as to have a thickness of 70 μm from the intermediate layer 5. For example, an epoxy resin (e.g., EHPE-3170 available from Daicel Corporation) can be used as the negative photosensitive resin material.

Figure 9E:
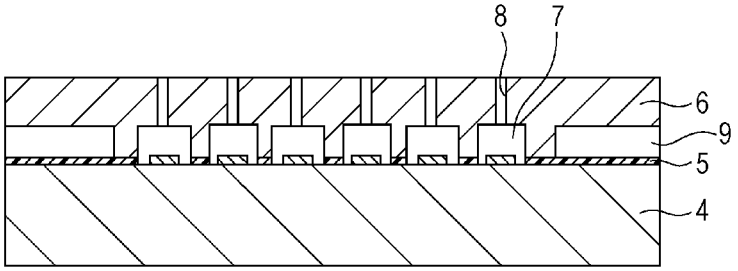

As illustrated in FIG. 9E, by removing the mold material 16 after the ejection port member forming step is completed, the pressure chamber 7 and the supply port 9 are formed (a supply port forming step). According to the present exemplary embodiment, the mold material 16 is soaked in methyl lactate having a temperature heated and maintained at 40° C., and ultrasonic waves of 200 kHz and 200 W are applied to methyl lactate. In this manner, the mold material 16 is eluted to form the supply port 9.

Through the above-described steps, the device substrate 1 is accomplished.

Note that according to the present exemplary embodiment, in order to increase adhesiveness between the substrate body 4 and the ejection port forming member 6, the intermediate layer 5 is formed. If sufficient adhesiveness is maintained even when the substrate body 4 is in direct contact with the ejection port forming member 6, the need for forming the intermediate layer 5 can be eliminated.

FIGS. 10A to 10E are cross-sectional views illustrating the manufacturing steps of the supporting member 2. In FIGS. 10A to 10E, a method for manufacturing the supporting member 2 by stacking five constituent members is illustrated.

Figure 10A:
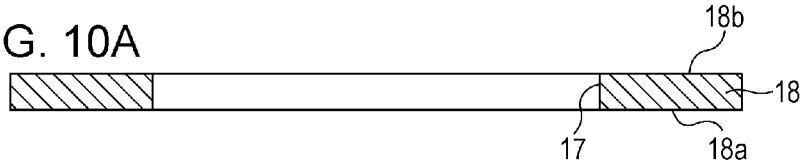
FIGS. 10A to 10E are cross-sectional views illustrating the steps for manufacturing a supporting member illustrated in FIGS. 8A to 8D.
Figure 11A:
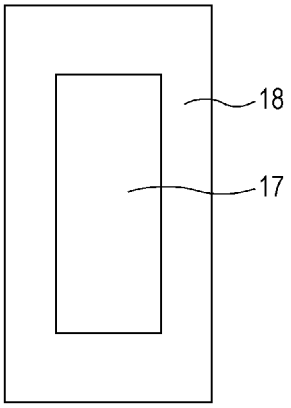
FIGS. 11A to 11E are top views of constituent members used for manufacturing the supporting member.

To manufacture the supporting member 2, as illustrated in FIG. 10A, a first constituent member 18 having a first through-hole 17 formed therein is prepared first. FIG. 11A is a top view of the first constituent member 18.

Among the surfaces of the first constituent member 18, a surface 18*a* in which one of two openings at both ends of the first through-hole 17 is located serves as the second surface 3*b* of the supporting member 2 (refer to FIGS. 1A and 1B). The opening of the first through-hole 17 located in the surface 18*a* serves as the second flow passage opening 14*b* (refer to FIGS. 1A and 1B). The first through-hole 17 passes through the first constituent member 18 from the surface 18*a* to the surface 18*b* that is opposite to the surface 18*a*. According to the present exemplary embodiment, the thickness of the first constituent member 18 is set to 1000 μm.

Figure 10B:
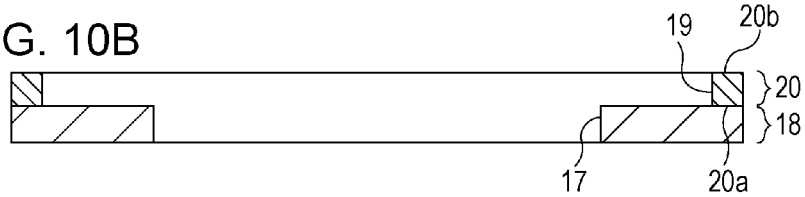
Figure 11B:
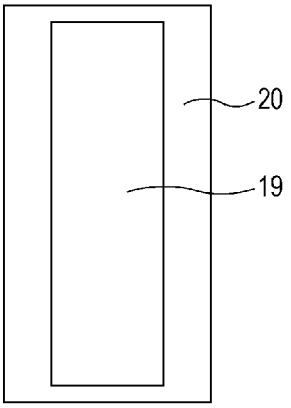

Subsequently, as illustrated in FIG. 10B, a second constituent member 20 having a second through-hole 19 formed therein is formed on a surface 18*b* of the first constituent member 18. FIG. 11B is a top view of the second constituent member 20.

The second through-hole 19 passes through the second constituent member 20 from a surface 20*a* of the second constituent member 20 that is in contact with the first constituent member 18 to a surface 20*b* that is opposite to the surface 20*a*. The second through-hole 19 communicates with the first through-hole 17. According to the present exemplary embodiment, the thickness of the second constituent member 20 is set to 1000 μm.

Figure 10C:
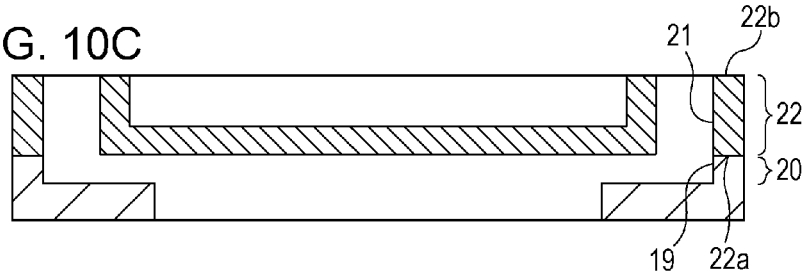
Figure 11C:
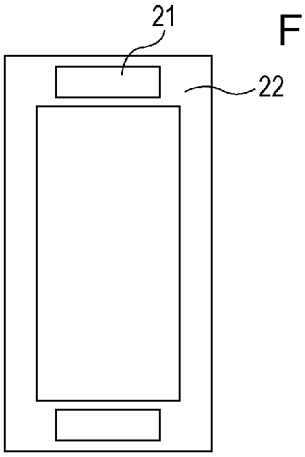

Subsequently, as illustrated in FIG. 10C, a third constituent member 22 having a third through-hole 21 formed therein is formed on the surface 20*b* of the second constituent member 20. FIG. 11C is a top view of the third constituent member 22.

The third constituent member 22 has a portion that serves as a bottom portion of the concave portion of the supporting member 2 (refer to FIGS. 1A and 1B). The third through-hole 21 passes through the third constituent member 22 from a surface 22*a* of the third constituent member 22 that is in contact with the second constituent member 20 to a surface 22*b* that is opposite to the surface 22*a*. The third through-hole 21 communicates with the second through-hole 19. According to the present exemplary embodiment, the thickness of the third constituent member 22 is set to 1000 μm.

Figure 10D:
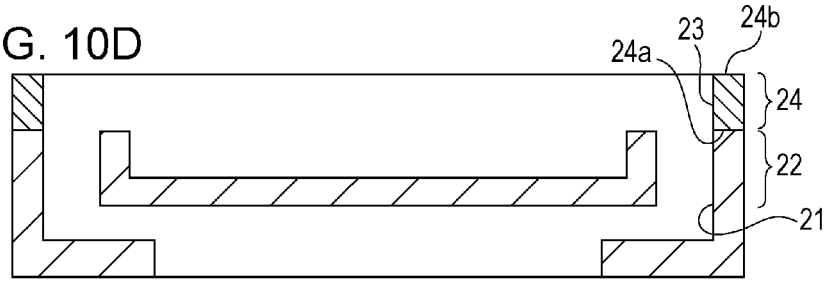
Figure 11D:
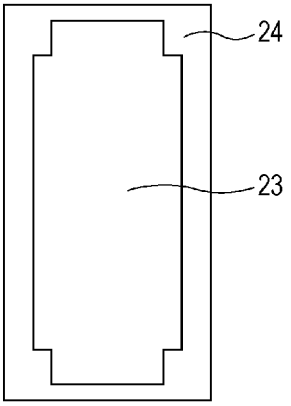

Subsequently, as illustrated in FIG. 10D, a fourth constituent member 24 having a fourth through-hole 23 formed therein is formed on the surface 22*b* of the third constituent member 22. FIG. 11D is a top view of the fourth constituent member 24.

The fourth through-hole 23 passes through the fourth constituent member 24 from a surface 24*a* of the fourth constituent member 24 that is in contact with the third constituent member 22 to a surface 24*b* that is opposite to the surface 24*a*. The fourth through-hole 23 communicates with the third through-hole 21.

In addition, the fourth through-hole 23 is located above the portion serving as a bottom portion of the concave portion of the supporting member 2 (refer to FIGS. 1A and 1B). That is, part of the fourth through-hole 23 serves as part of the concave portion of the supporting member 2. According to the present exemplary embodiment, the thickness of the fourth constituent member 24 is set to 250 μm.

Figure 10E:
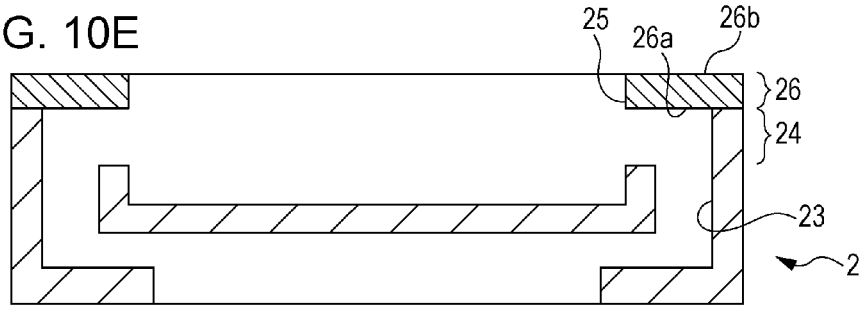
Figure 11E:
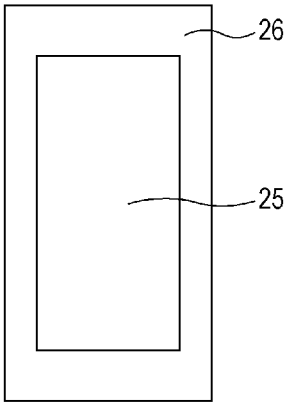

After the fourth constituent member 24 is formed on the third constituent member 22, a fifth constituent member 26 having a fifth through-hole 25 formed therein is formed on the surface 24*b* of the fourth constituent member 24, as illustrated in FIG. 10E. FIG. 11E is a top view of the fifth constituent member 26.

The fifth through-hole 25 passes through the fifth constituent member 26 from a surface 26*a* of the fifth constituent member 26 that is in contact with the fourth constituent member 24 to a surface 26*b* that is opposite to the surface 26*a*. In addition, the fifth through-hole 25 is located only above a portion of the supporting member 2 (refer to FIGS. 1A and 1B) serving as the bottom portion of the concave portion of the supporting member 2. That is, part of the fifth through-hole 25 serves as part of the concave portion of the supporting member 2, and the surface 26*b* of the fifth constituent member 26 serves as the first surface 2*a* of the supporting member 2 (refer to FIGS. 1A and 1B). According to the present exemplary embodiment, the thickness of the fifth constituent member 26 is set to 50 μm.

Through the above-described steps, the supporting member 2 is accomplished. Note that the first to fifth constituent members 18, 20, 22, 24, and 26 may be stacked to form a laminate body. Thereafter, the laminate body may be fired to form one member integrated with the supporting member 2.

It is desirable that the first to fifth constituent members 18, 20, 22, 24, and 26 be made of a material having resistance to ink and allowing the device substrate 1 (refer to FIGS. 1A and 1B) to be adhered thereto, and it is more desirable that the first to fifth constituent members 18, 20, 22, 24, and 26 be made of a material having a coefficient of linear expansion that is substantially the same as that of the substrate body 4 (refer to FIGS. 1A and 1B) and having a thermal conductivity that is substantially the same as that of the substrate body 4 or higher.

While the present exemplary embodiment has been described with reference to the first to fifth constituent members 18, 20, 22, 24, and 26 made of alumina (oxidized aluminum), the material of the supporting member 2 is not limited thereto. For example, the supporting member 2 may be formed of, for example, silicon (Si), aluminum nitride (AlN), zirconia ($ZrO_2$), silicon nitride ($Si_3N_4$), silicon carbide (SiC), molybdenum (Mo), or tungsten (W).

Figure 12A:
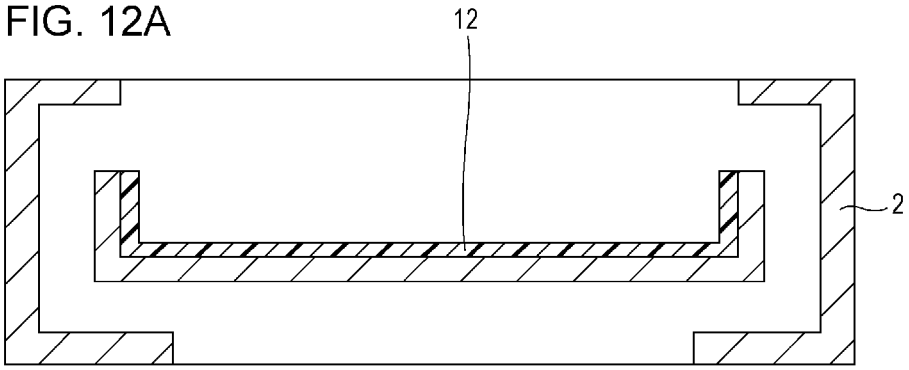
FIGS. 12A to 12C are cross-sectional views illustrating the steps for attaching the device substrate to the supporting member.
Figure 12B:
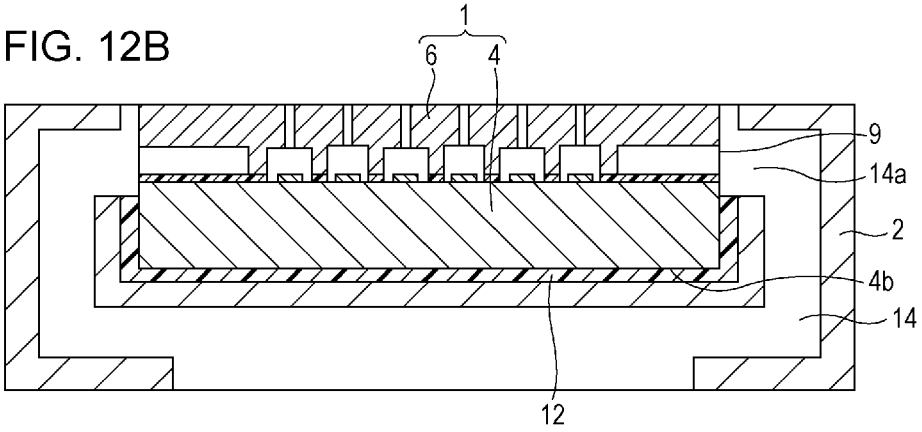
Figure 12C:
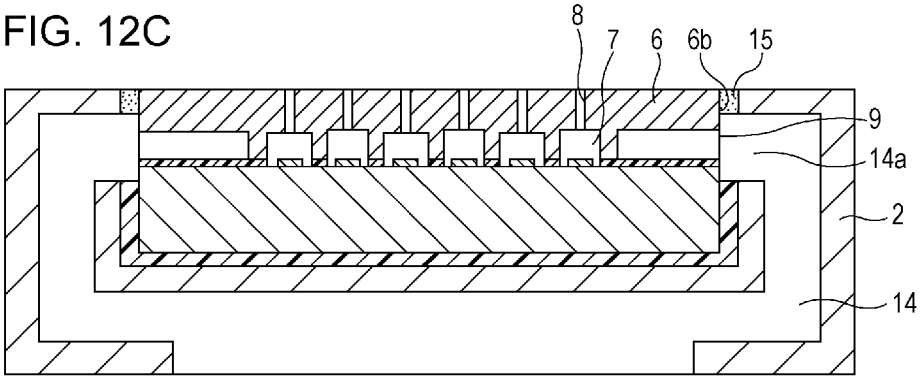

FIGS. 12A to 12C are cross-sectional views illustrating steps for attaching the device substrate 1 to the supporting member 2.

As illustrated in FIG. 12A, the adhesive agent 12 is applied to the bottom of the concave portion of the supporting member 2 first. According to the present exemplary embodiment, the adhesive agent 12 is applied to a region of the bottom in which the back surface 4*b* (refer to FIGS. 1A and 1B) of the substrate body 4 is to be placed. A thermosetting resin material, such as epoxy resin, can be used as the adhesive agent 12.

Subsequently, as illustrated in FIG. 12B, the device substrate 1 is disposed in the concave portion of the supporting member 2. At that time, the back surface 4*b* of the substrate body 4 is fixed to the bottom of the concave portion of the supporting member 2 using the adhesive agent 12. The supply port 9 faces the first flow passage opening 14*a*, and the flow passage 14 communicates with the supply port 9.

Subsequently, as illustrated in FIG. 12C, a gap formed between the ejection port forming member 6 and the supporting member 2 is filled with the sealing agent 15. By sealing the gap with the sealing agent 15, the liquid is supplied from the flow passage 14 to the supply port 9 without leaking out through the gap and is ejected from the ejection port 8.

According to the present exemplary embodiment, the gap between the ejection port forming member 6 and the supporting member 2 is filled with the sealing agent 15 using a capillary phenomenon. More specifically, an adequate amount of the sealing agent 15 is applied to a portion in the vicinity of the gap and is left for a predetermined amount of time. Due to a capillary phenomenon, the sealing agent 15 enters the gap, and the gap is filled with the sealing agent 15. By adjusting the amount of the sealing agent 15 applied, the sealing agent 15 seals the gap without sealing the supply port 9 and the first flow passage opening 14*a*.

Through the above-described steps, the device substrate 1 is attached to the supporting member 2. Thus, the liquid ejection head is accomplished.

While the first and second exemplary embodiments have been described with reference to the second surface 6*b* that has the supply port 9 formed therein and that is adjacent to the first surface 6*a*, the second surface 6*b* may be any surface other than the first surface 6*a*. For example, among the surfaces of the ejection port forming member 6, a surface opposite to the first surfaces 7*b* (the surface having the ejection port 8 formed therein in FIGS. 1A and 1B or FIGS. 7A and 7B) may be the second surface 6*b*.

According to the present invention, since the supply port is formed in the second surface of the ejection port forming member, the need for reducing the size of the supply port when the size of the substrate body is reduced can be lessened. Accordingly, the size of the substrate body can be reduced without decreasing the amount of liquid supplied to the pressure chamber.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-103035 filed May 15, 2013, which is hereby incorporated by reference herein in its entirety.

What is claimed is:

1. A device substrate comprising:

a substrate body having an energy generating device provided thereon, the energy generating device generating energy for ejecting liquid;

an ejection port forming member disposed on the substrate body, the ejection port forming member having a pressure chamber that surrounds the energy generating device and at least one ejection port that communicates with the pressure chamber; and a supply port configured to supply the liquid to the pressure chamber, wherein the ejection port forming member has a first surface, which is in contact with the substrate body, and a second surface other than the first surface, and the supply port is formed in the second surface.

2. The device substrate according to claim 1, wherein the ejection port forming member includes a plurality of the ejection ports arranged in a predetermined direction, and wherein the second surface is one of a surface extending in the predetermined direction and a surface intersecting the predetermined direction.

3. The device substrate according to claim 1, wherein the substrate body is a member not having the supply port formed therein.

4. The device substrate according to claim 1, wherein the substrate body is a member not having a through-hole formed therein.

5. A liquid ejection head comprising:

the device substrate according to claim 1; and a supporting member configured to support the device substrate, wherein the supporting member includes a flow passage that communicates with the supply port.

6. The liquid ejection head according to claim 5, wherein the supporting member has a concave portion, wherein the device substrate is disposed in the concave portion so that the supply port faces an inner side surface of the concave portion, wherein an opening of the flow passage is formed in the inner side surface at a position facing the supply port, and wherein a gap formed between the second surface and the inner side surface is sealed with a sealing agent.

7. The liquid ejection head according to claim 6, wherein a size of the opening of the flow passage is greater than a size of the supply port.

8. A method for manufacturing a device substrate, the device substrate including a substrate body having an energy generating device provided thereon, where the energy generating device generates energy for ejecting liquid, an ejection port forming member disposed on the substrate body, where the ejection port forming member has a pressure chamber that surrounds the energy generating device and at least one ejection port that communicates with the pressure chamber, and a supply port configured to supply the liquid to the pressure chamber, where the ejection port forming member has a first surface, which is in contact with the substrate body, and a second surface other than the first surface, and the supply port is formed in the second surface, the method comprising:

a mold material forming step of forming a mold material on the substrate body having the energy generating device formed therein between a portion to be formed into the supply port and a portion to be formed into the pressure chamber;

an ejection port member forming step of forming the ejection port forming member on the substrate body and the mold material without covering a portion of the mold material to be formed into the supply port; and a supply port forming step of forming the supply port that communicates with the pressure chamber by removing the mold material.

9. The method for manufacturing a device substrate according to claim 8, wherein the ejection port member forming step includes forming a plurality of portions of the mold material each to be formed into the ejection port so that the portions are arranged in a predetermined direction, and wherein the portions to be formed into the supply ports are provided in one of a surface of the mold material that extends in the predetermined direction and a surface of the mold material that intersects the predetermined direction.

10. The method for manufacturing a device substrate according to claim 8, wherein the substrate body is a member not having the supply port formed therein.

11. The method for manufacturing a device substrate according to claim 8, wherein the substrate body is a member not having a through-hole formed therein.

* * * * *